US007866705B2

(12) United States Patent
Mayer et al.

(10) Patent No.: US 7,866,705 B2
(45) Date of Patent: Jan. 11, 2011

(54) ICE SKATE BLADE GUARD

(75) Inventors: Dave Mayer, St. Charles, MI (US); Victor Posa, Grand Blanc, MI (US); Paul M. Steinhauser, Jr., Davison, MI (US)

(73) Assignee: Rollergard, L.L.C., St. Charles, MI (US)

( * ) Notice: Subject to any disclaimer, the term of this patent is extended or adjusted under 35 U.S.C. 154(b) by 816 days.

(21) Appl. No.: 11/688,943

(22) Filed: Mar. 21, 2007

(65) Prior Publication Data

US 2008/0231007 A1 Sep. 25, 2008

(51) Int. Cl.
*A63C 3/12* (2006.01)

(52) U.S. Cl. ..... 280/825; 280/7.13

(58) Field of Classification Search ..... 280/608, 280/825, 811, 11.221, 809, 7.13
See application file for complete search history.

(56) References Cited

U.S. PATENT DOCUMENTS

| | | | | |
|---|---|---|---|---|
| 226,835 | A | 4/1880 | Chesterman | |
| 250,319 | A | 11/1881 | Yates | |
| 310,923 | A | 1/1885 | Wardell | |
| 339,318 | A | 4/1886 | Peer | |
| 1,174,601 | A | 3/1916 | Nathan | |
| 1,341,853 | A | 6/1920 | Johnson | |
| 1,346,568 | A | 7/1920 | Swift | |
| 1,447,431 | A | 3/1923 | Ritter | |
| 1,544,770 | A | 7/1925 | Swift | |
| 1,554,434 | A | 9/1925 | Johnson | |
| 1,557,415 | A | 10/1925 | Carey | |
| 1,658,093 | A | 2/1928 | Nygaard | |
| 1,788,433 | A * | 1/1931 | Johnson | 280/825 |
| 1,925,697 | A * | 9/1933 | Johnson | 280/825 |
| 1,982,524 | A * | 11/1934 | Kutchera | 280/825 |
| 2,181,834 | A * | 11/1939 | Pierce et al. | 280/825 |
| 2,213,966 | A * | 9/1940 | Nygaard | 280/11.18 |
| 2,395,394 | A | 2/1946 | Carlson | |
| 2,642,291 | A * | 6/1953 | Condon | 280/825 |
| D189,923 | S * | 3/1961 | Swatt | D21/772 |
| 3,015,492 | A * | 1/1962 | Kesner et al. | 280/825 |
| 3,135,526 | A * | 6/1964 | Johns | 280/825 |
| 3,281,971 | A | 11/1966 | Weitzner | |
| 3,292,940 | A * | 12/1966 | Weitzner | 280/7.13 |
| 3,338,588 | A | 8/1967 | Couture | |
| 3,583,720 | A | 6/1971 | Fowlkes | |

(Continued)

FOREIGN PATENT DOCUMENTS

| | | |
|---|---|---|
| CH | 604785 | 9/1978 |

*Primary Examiner*—J. Allen Shriver, II
*Assistant Examiner*—Jacob Meyer
(74) *Attorney, Agent, or Firm*—Robert L. Stearns; Dickinson Wright, PLLC

(57) ABSTRACT

A blade guard for a runner blade of an ice skate. The blade guard includes a channel extending a distance between first and second ends. The channel has an open top and a bottom surface and first and second opposing side surfaces extending from the bottom surface to the open top. The blade guard also includes at least one recess disposed below the channel and extending a distance transverse to the distance of the channel. The at least one recess includes first and second countersink portions at opposite ends of the distance and a center portion. A first shoulder is defined between the first countersink portion and the center portion and a second shoulder is defined between the second countersink portion and the center portion.

11 Claims, 8 Drawing Sheets

U.S. PATENT DOCUMENTS 3,954,278 A * 5/1976 McLeod ..... 280/825
4,252,345 A * 2/1981 Cabral ..... 280/825
4,264,090 A * 4/1981 Davies ..... 280/825
4,324,408 A * 4/1982 Bensette et al. ..... 280/7.13
4,382,616 A * 5/1983 Olivieri ..... 280/825
4,392,674 A * 7/1983 Evon ..... 280/825
D271,410 S * 11/1983 Olivieri ..... D21/761
4,492,385 A * 1/1985 Olson ..... 280/7.13
4,546,999 A * 10/1985 Lehr ..... 280/825
4,603,868 A * 8/1986 Schutz ..... 280/7.13
4,673,196 A * 6/1987 Hall ..... 280/825
5,183,292 A * 2/1993 Ragin, III ..... 280/825
5,290,065 A 3/1994 Kassel
5,303,955 A 4/1994 Zumamer
5,513,881 A 5/1996 DiMeglio et al.
5,573,275 A * 11/1996 Smith et al. ..... 280/825
5,580,094 A 12/1996 Ruehlman et al.
5,697,643 A 12/1997 Marasco et al.
5,765,870 A 6/1998 Riley
5,848,808 A * 12/1998 Fenton ..... 280/825
5,941,568 A * 8/1999 White, II ..... 280/825
5,988,682 A 11/1999 Allera
6,032,962 A 3/2000 DiGregorio
6,142,528 A 11/2000 Riley
6,193,277 B1 * 2/2001 Marasco et al. ..... 280/825
D453,204 S 1/2002 Haldenby
6,446,982 B1 9/2002 Gaster et al.
6,666,479 B1 12/2003 Maddaleni
6,916,046 B2 7/2005 Riley et al.
D566,216 S * 4/2008 Mayer et al. ..... D21/771
D574,458 S * 8/2008 Mayer et al. ..... D21/772
2002/0175481 A1 * 11/2002 Steinhauser, Jr. ..... 280/11.18
2003/0011149 A1 * 1/2003 Gaster et al. ..... 280/7.17
2004/0032098 A1 * 2/2004 Gaster et al. ..... 280/11.19
2004/0140661 A1 * 7/2004 Guyon et al. ..... 280/825
2005/0127651 A1 6/2005 Cuerrier
2005/0127661 A1 * 6/2005 Cuerrier ..... 280/825
2007/0075540 A1 * 4/2007 Steinhauser, Jr. ..... 280/825

* cited by examiner

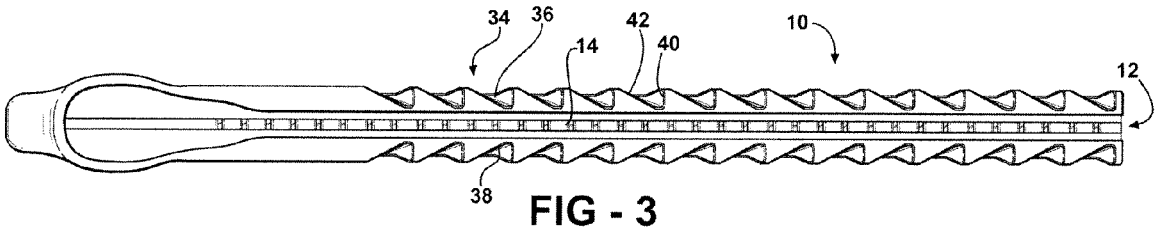
FIG - 3
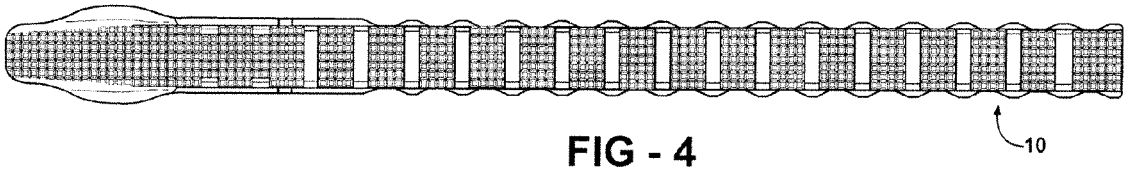
FIG - 4
FIG - 5
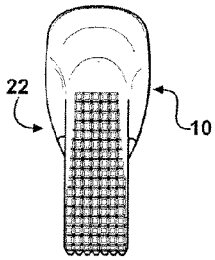
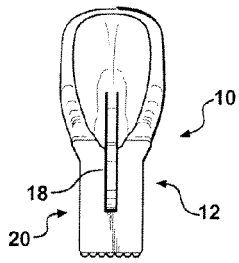
FIG - 6

ICE SKATE BLADE GUARD

BACKGROUND OF THE INVENTION

1. Field of the Invention

The invention relates to a blade guard for protecting the blade of an ice skate.

2. Description of Related Prior Art

During the use of ice skates, it may be desirable to traverse distances that are not covered in ice. For example, it may be desirable and/or necessary to don ice skates outside of a skating rink and then walk into the rink due to limited space in the rink. Similarly, for the same reason, it may be desirable to leave the ice and immediately proceed outside of the rink, to a vehicle for example. Alternatively, it may be desirable to move back-and-forth between the ice and a rest area spaced from the ice. During movement away from the ice, it is desirable to protect the blade of the skate from damage and dulling that can occur as a result of contact between the bottom of the blade and a surface that is not ice.

SUMMARY OF THE INVENTION

In summary, the invention is a blade guard for a runner blade of an ice skate. The blade guard includes a channel extending a distance between first and second ends. The channel has an open top and a bottom surface and first and second opposing side surfaces extending from the bottom surface to the open top. The blade guard also includes at least one recess disposed below the channel and extending a distance transverse to the distance of the channel. The at least one recess includes first and second countersink portions at opposite ends of the distance and a center portion. A first shoulder is defined between the first countersink portion and the center portion and a second shoulder is defined between the second countersink portion and the center portion.

BRIEF DESCRIPTION OF THE DRAWINGS

Advantages of the present invention will be readily appreciated as the same becomes better understood by reference to the following detailed description when considered in connection with the accompanying drawings wherein:

FIG. 3 is a top view of the blade guard shown in FIG. 1;

FIG. 4 is a bottom view of the blade guard shown in FIG. 1;

FIG. 5 is a left-hand view of the blade guard shown in FIG. 1;

FIG. 6 is a right-hand view of the blade guard shown in FIG. 1;

DETAILED DESCRIPTION OF THE EXEMPLARY EMBODIMENT

Figure 11:
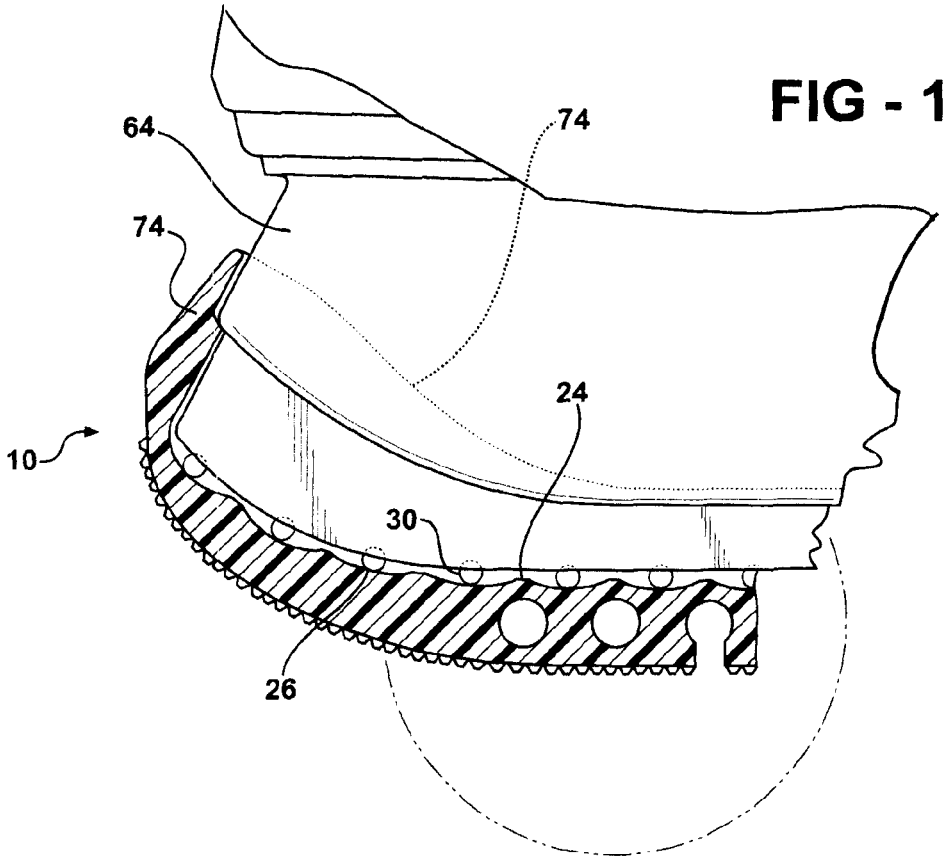
FIG. 11 is detail view of the prow end of the combination shown in FIG. 9 with a portion of the blade guard cut-away to reveal the engagement between a platform of the skate and a cup portion of the blade guard.

Referring now to FIGS. 1-6, a blade guard 10 can be used to cover and protect a runner blade of an ice skate. The blade guard 10 includes a longitudinally extending body with an open-topped channel 12 for receiving the runner blade. The body includes side walls 13, 15 and bottom wall 17. The channel 12 has a bottom surface 14 and first and second opposing side surfaces 16, 18. The side surfaces 16, 18 extend from the bottom surface 14 to an open top. The channel 12 extends a distance/length between a first open end 20 and a second closed end 22. As best seen in FIG. 11, the bottom surface 14 is wavy, having a plurality of crests 24 and a plurality of valleys 26 alternatively arranged along the length. The blade guard 10 can be formed into a desired shape in a one-step or multi-step molding operation, including all recesses, protuberances, apertures, slots and any other structural feature. Alternatively, the blade guard 10 can be formed with less than all structural features in a molding operation and then be subjected to post-molding machining to form any other desired structural features.

The exemplary blade guard 10 includes a plurality of weep apertures 28 to allow fluid to drain from the channel 12. The weep apertures 28 extend from a first opening 30 in the channel 12 to a second opening 32 spaced from the channel 12. The openings 30 of the weep apertures 28 are disposed in the channel 12 between the open and closed ends 20, 22. The weep apertures 28 are defined by a surface 28 that extends around a void. Each of the apertures 28 extend in a direction that is not perpendicular to the bottom surface 14 of the channel 12. As a result, it is less likely that the weep apertures 28 will become clogged. In the exemplary embodiment of the invention, the weep apertures 28 extend in a direction parallel to the bottom surface 14. Also, in the exemplary embodiment of the invention, the first opening 30 is disposed adjacent to one of the plurality of valleys 26 in the bottom surface 14 to enhance drainage from the channel 12.

Figure 9:
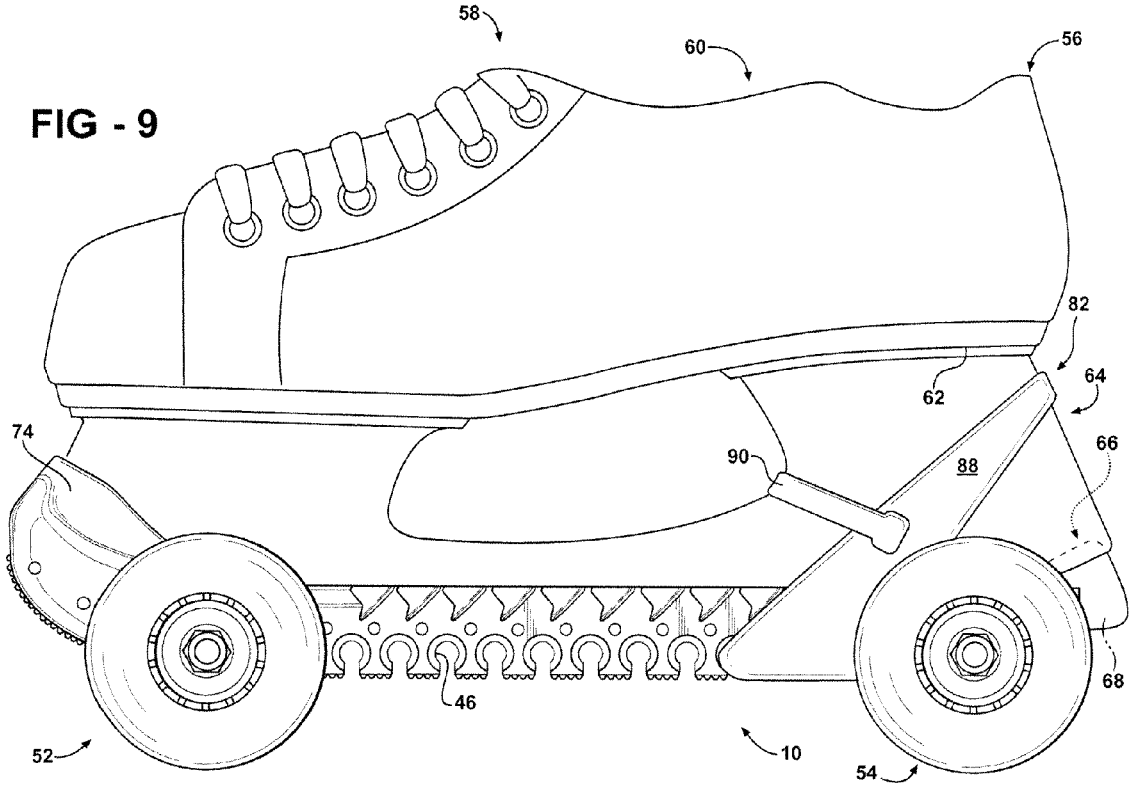
FIG. 9 is front view of the blade guard shown in FIG. 1 in combination with a skate, a strap and two wheel assemblies that can be adjustably positioned along a length of the blade guard.

The exemplary blade guard 10 also includes a plurality of slot pairs 34 spaced along the length. Each of the slot pairs 34 includes first and second slots 36, 38 that both open away from the channel 12. The first and second slots 36, 38 are mirror images of one another across the channel 12. The slot pairs 34 can receive a strap that may be used to secure the blade guard 10 with respect to an ice skate, such as shown in FIG. 9. Each slot 36, 38 includes a first surface 40 a second surface 42 opposing the first surface 40. The first and second surfaces 40, 42 define different angles with respect to the channel 12, as best shown in FIG. 3. The first surface 40 of the recess 34 is disposed closer to the open end 20 of the channel 12 and defines a larger angle with the channel 12 than second surface 42. In the exemplary embodiment of the invention, the first surface 40 is substantially perpendicular to the channel 12 and the second surface 42 defines a substantially acute angle with the channel 12. This arrangement allows a strap to be received and substantially held against movement. A strap can "ride" against the perpendicular surface 40 and thereby held against movement along the length of the channel 12.

Figure 10:
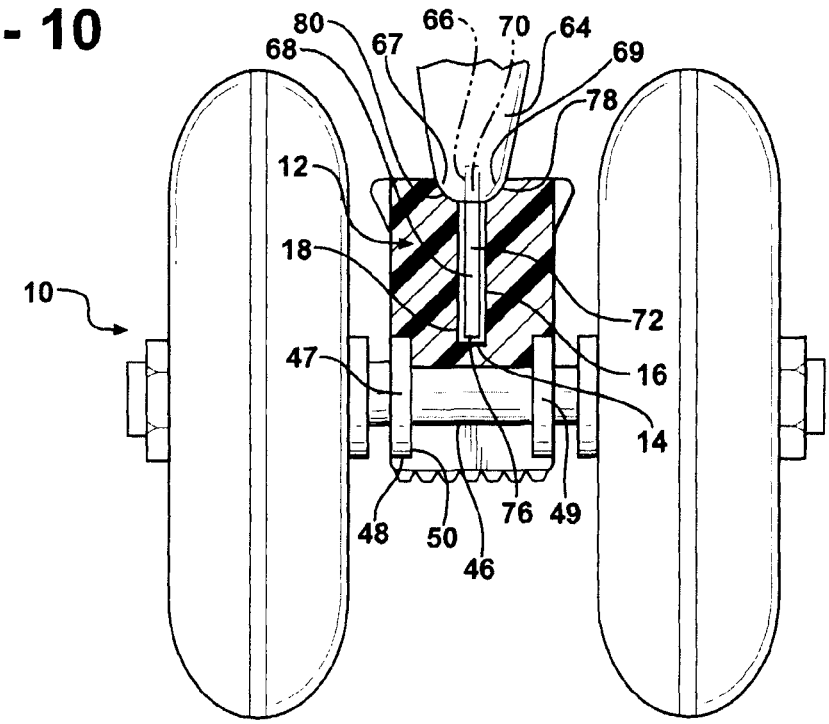
FIG. 10 is a cross-sectional view of the combination shown in FIG. 9 taken from a perspective shown by the perspective line 10-10 in FIG. 8.

The exemplary blade guard 10 also includes a plurality of recesses 44 extending below the channel 12 and transverse to the length. The recesses 44 can individually receive a complete or partial wheel assembly or a portion of a strap. Each of the plurality of recesses 44 includes a through-hole or center portion 46 and a countersink portion 48 with a shoulder 50 defined between the through-hole portion 46 and the countersink portion 48. The countersink portion 48 can receive bearings of a wheel assembly or some portion of a strap. FIG. 10 shows bearing assemblies 47, 49 disposed in opposite countersink portions 48. The side and perspective views of the figures show that most of the recesses 44 define less define less than a full circle in a cross-section perpendicular to the distance of the recess 44. These views also show that the open recesses 44 open in a direction away from said channel, or downward. The gap in the open recesses 44 is disposed a maximum distance from the channel 12. Some of the recesses 44 are closed apertures.

The exemplary blade guard 10 also defines grid-like pattern 96 on a bottom surface. The pattern 96 is textured and can be desirable if the user is walking with blade guard 10. Specifically, the pattern 96 can enhance the gripping contact between the blade guard 10 and the surface being traversed.

Figure 1:
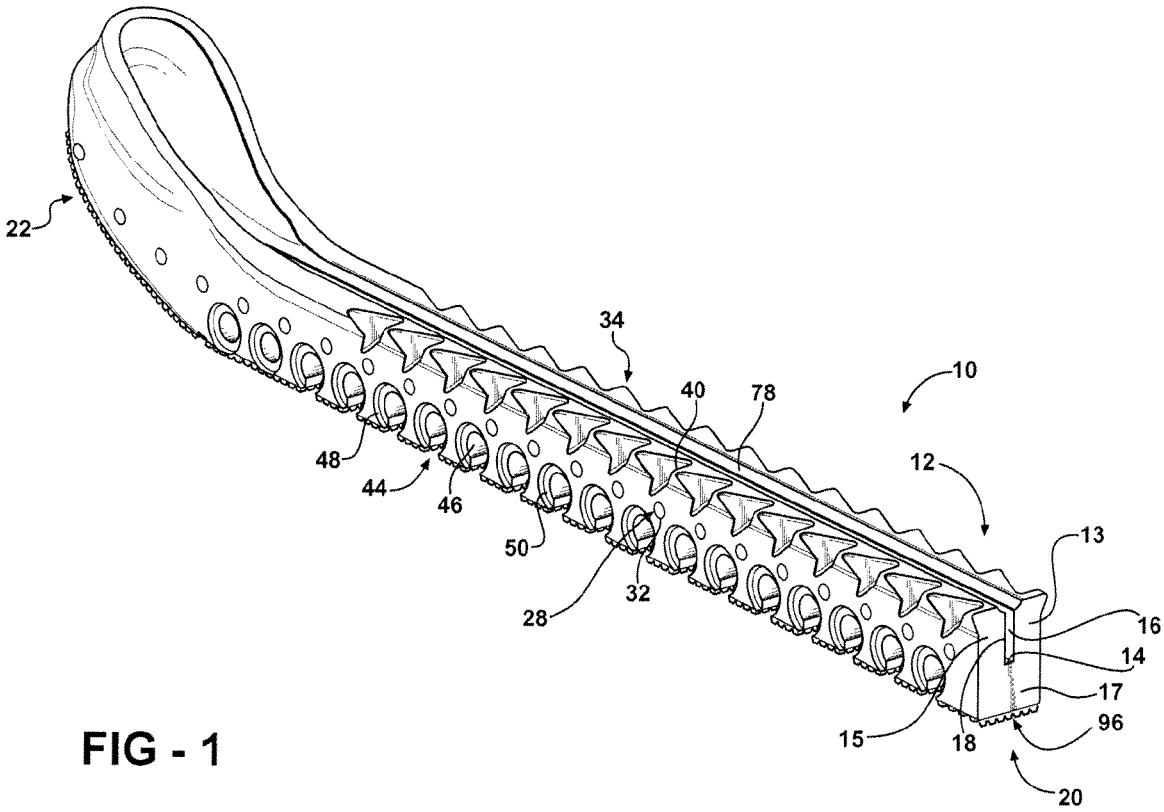
FIG. 1 is a first perspective view of a blade guard according to the exemplary embodiment of the invention having a body with longitudinal channel and a top, bottom and first and second opposite sides, wherein the bottom and the second side is not in view.
Figure 2:
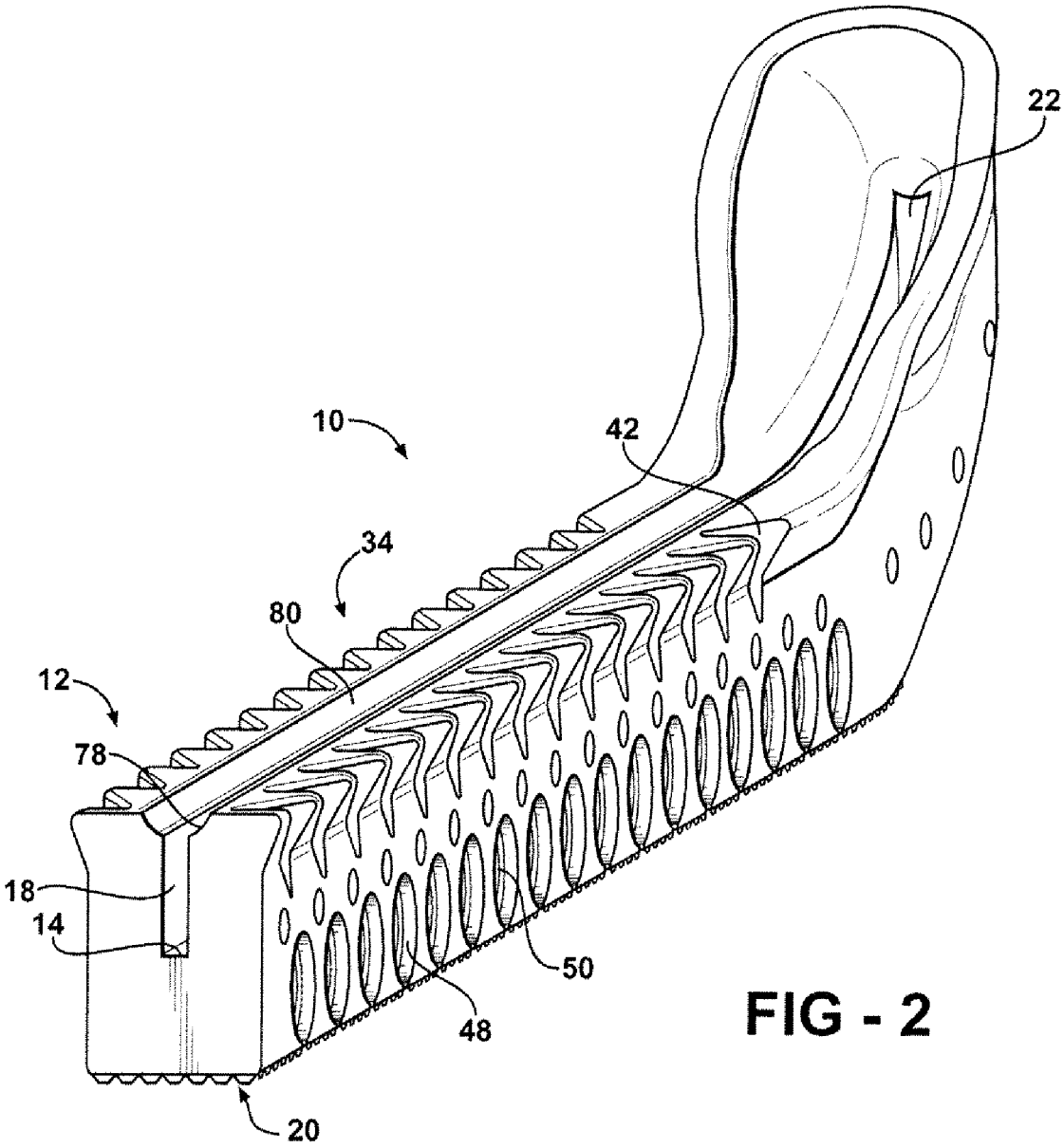
FIG. 2 is a second perspective view of the blade guard shown in FIG. 1 wherein the bottom and the first side is not in view.
Figure 7:
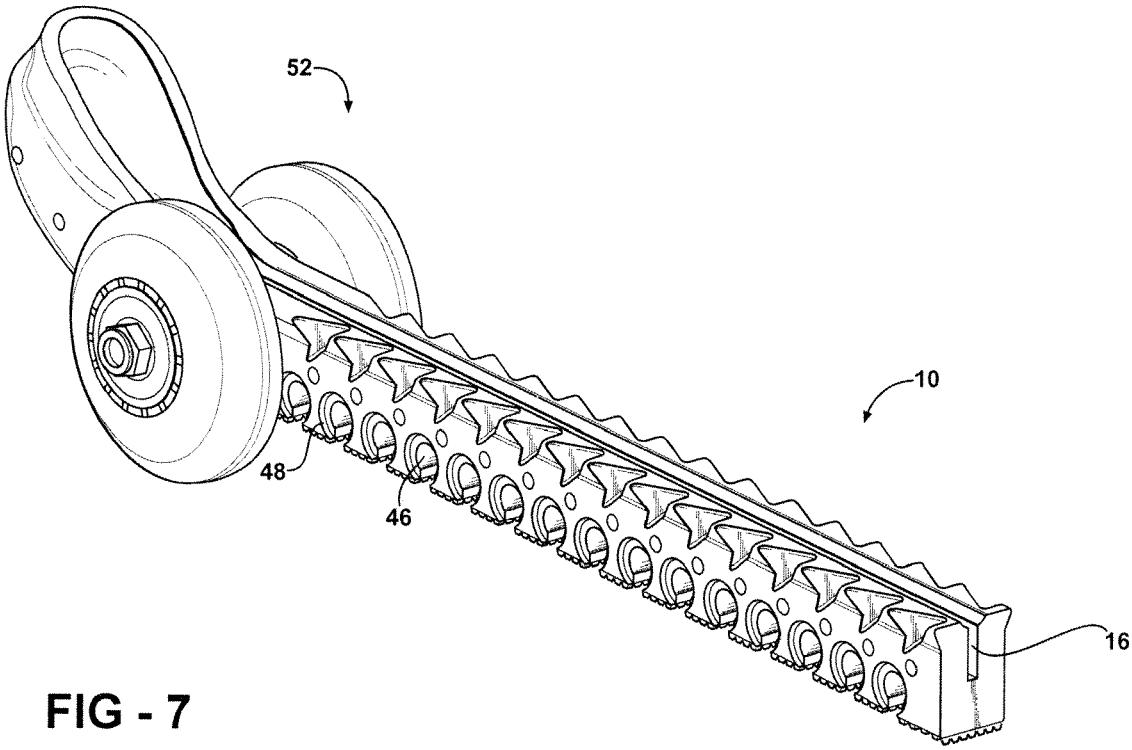
FIG. 7 is a perspective view of the blade guard shown in FIG. 1 in combination with a fixed wheel assembly adjacent to a prow end of the blade guard.
Figure 8:
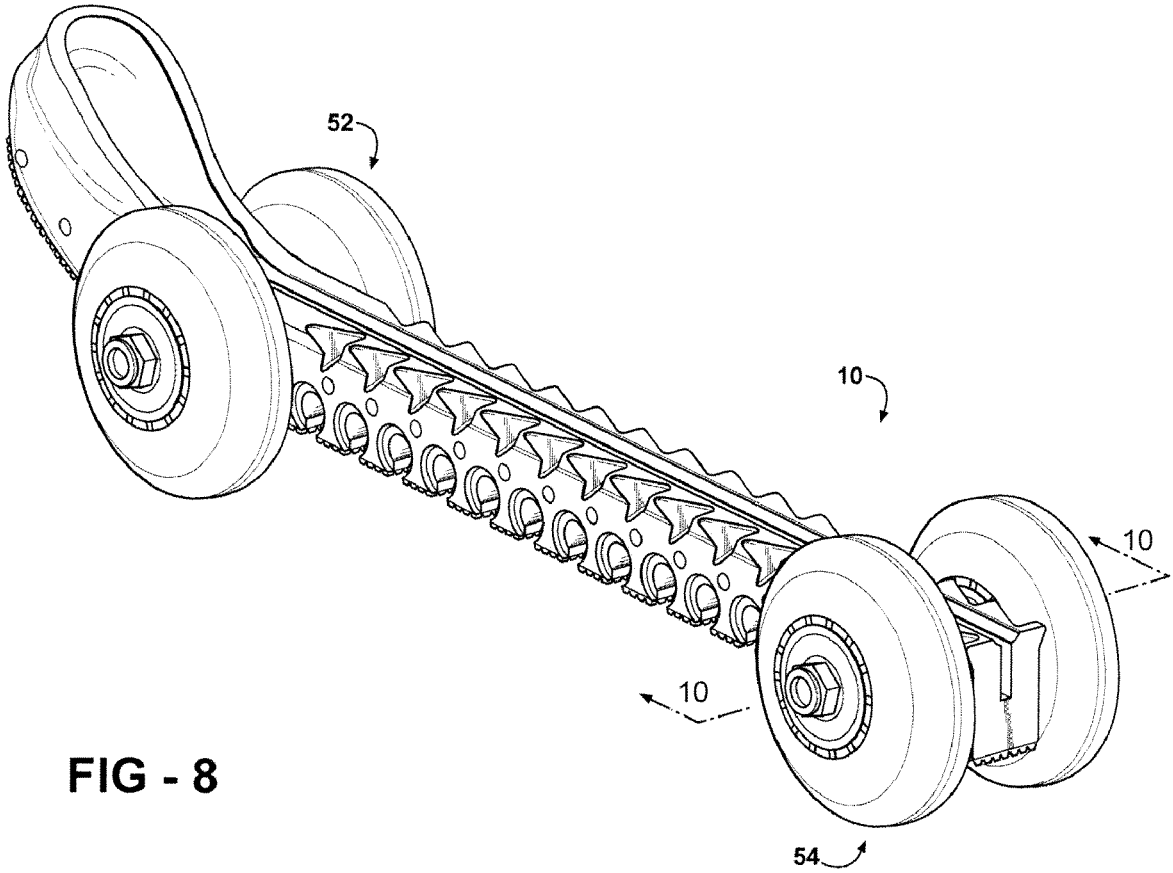
FIG. 8 is a perspective view of the blade guard shown in FIG. 1 in combination with two wheel assemblies that can be adjustably positioned along a length of the blade guard.

Referring now to FIG. 7, the invention can be practiced in an embodiment wherein the blade guard 10 is combined with a first wheel assembly 52 that is fixedly engaged with respect to the channel 12. The wheel assembly 52 may be removable to replace the wheels or a bearing, but the position of the wheel assembly 52 along the length is fixed in this embodiment of the invention. A second wheel assembly 54 could be adjustably engageable with respect to the channel 12, such as by mounting in one of the mounting apertures 44 as shown in FIG. 8.

FIGS. 9-11 show the blade guard 10 in combination with an ice skate 56 to from and an ice skate assembly 58. The ice skate 56 includes a foot receptacle 60, such as a shoe or a boot, having a bottom surface 62. The ice skate 56 also includes a platform 64 fixedly engaged with the bottom surface 62. The platform 64 defines a channel or slot 66 (shown partially in phantom) with shoulders 67 and 69 on opposite sides of the channel 66. The ice skate 56 also includes a runner blade 68. The runner blade 68 has a first portion 70 received in the channel 66 and a second portion 72 extending out of the channel 66. The channel 12 of the blade guard 10 receives the second portion 72 of the runner blade 68.

The exemplary blade guard 10 includes a cup portion 74 partially encircling the platform 64. The cooperative engagement between the cup portion 74 and the platform 64 substantially reduces the likelihood that the blade guard 10 will separate from the ice skate 56. The cup portion 74 defines an under-cut that is at least partially elastically deformed around the platform 64 when the skate guard 10 is initially engaged with the ice skate 56.

Another feature provided by the exemplary embodiment of the invention is that the runner blade 68 is spaced from the bottom surface 14 of the channel 12. The runner blade 68 extends to a running surface 76 and, as shown in FIG. 10, the running surface 76 is spaced from the bottom surface 14. The skate guard 10 includes a pair of arcuate receiving surfaces 78, 80 (or support surfaces) that receive the platform 64. The channel 12 is formed with sufficient depth to allow the runner blade 68 to be spaced from the bottom surface 14. The surfaces 78, 80 receive and support the platform 64 along the entire length of the blade 68.

Figure 12:
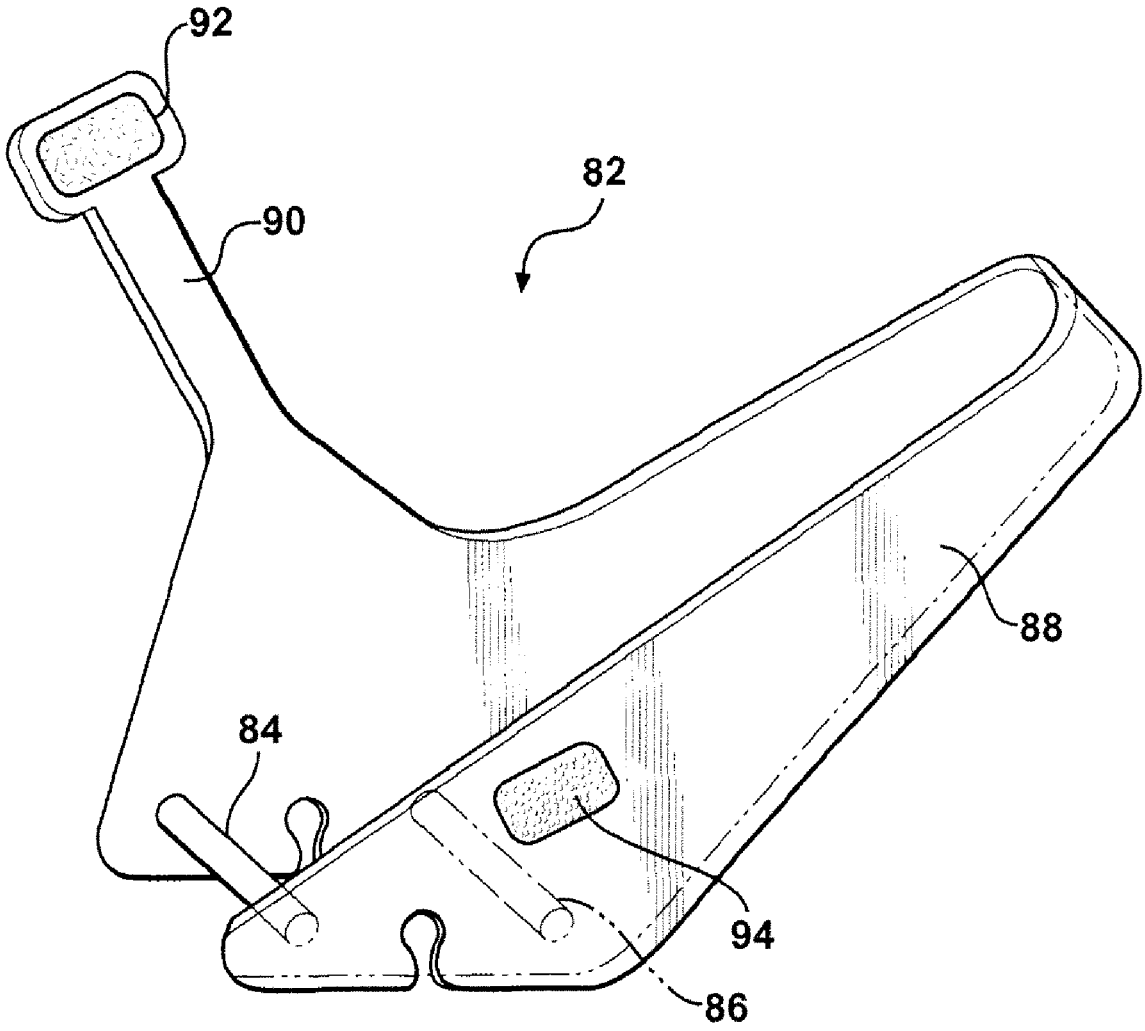
FIG. 12 is a perspective view of the strap shown in FIG. 9.

As best shown in FIGS. 9 and 12, the ice skate assembly 58 includes a strap 82 to reduce the likelihood that the skate guard 10 and the ice skate 56 separate from one another. The strap 82 includes shafts 84, 86 that received in separate mounting apertures 44. Alternative embodiments of the strap 82 may include only one shaft. The strap 82 also includes a u-shaped resilient band 88 cooperating with the shafts 84, 86 to define a closed loop. The closed loop encircles a first portion of the platform 64, the heel end or aft end. The strap 82 also includes a resilient arm 90 extending cantilevered from said u-shaped resilient band. The strap 82 also includes a hook portion 92 disposed on either the arm 90 or the band 88 and a loop 94 portion disposed on the other. The arm 90 is deformable to engage the hook and loop portions 92, 94 together to define a second closed loop. The second closed loop encircles a second portion of the platform 64, a middle portion between the toe and heel ends. Alternative embodiments of the invention may be formed without the arm 90.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An ice skate and skate guard assembly comprising:

a skate boot with a sole;

a platform extending downwardly from said sole of said boot and terminating at a pair of longitudinally extending and laterally spaced shoulders with a bottom slot arranged between said shoulders;

a blade disposed partially in said slot and partially projecting out of said slot beyond said shoulders to an edge;

a skate guard having a longitudinally extending body formed with an open-topped channel bounded by a pair of laterally spaced side walls and a bottom wall, said channel sized to receive said edge of said blade and maintain said edge from contact with said bottom wall, wherein said side walls include respective upper support surfaces that engage said shoulders of said platform such that weight of a user is transferred from said skate to said skate guard directly between said shoulders and said upper support surfaces; and at least a pair of wheels mounted on said skate guard in longitudinally spaced relation to one another, and wherein both of said side walls contact opposite sides of said portion of said blade in said channel substantially along a full length of said blade, and said platform has a front nose portion that extends from a front tip of said blade rearwardly and upwardly, and wherein said skate guard includes an undercut cup portion at a front end of said platform that wraps around said front tip and pockets said nose in said cup portion precluding said skate guard from being pulled free of said ice skate without first sliding said skateguard forwardly to remove said nose form said undercut pocket of said skate guard.

2. The ice skate assembly of claim 1 wherein said skate guard includes a strap wrappable around a rear portion of said platform to anchor said nose within said cup portion by applying a constant rearward sliding forward on said skate guard relative to said ice skate.

3. The ice skate assembly of claim 2 wherein said strap is elastic.

4. The ice skate assembly of claim 3 wherein said skate guard includes a plurality of longitudinally spaced recesses formed in a bottom surface of said skate guard and said strap including at least one mounting shaft receivable in a selected one or more of said recesses to secure said strap adjustably to said skate guard at any of several positions of longitudinal adjustment.

5. The ice skate assembly of claim 4 wherein said side walls include countersunk recesses surrounding at least some of said recesses on laterally opposite sides of said skate guard.

6. The ice skate assembly of claim 1 wherein said bottom wall includes an irregular shaped floor with areas of peaks and areas of valleys adjacent said areas of peaks, and said skating edge of said blade is spaced from said peaks.

7. The ice skate assembly of claim 6 wherein said side walls include drain holes associated with at least some of said valleys.

8. The ice skate assembly of claim 1 wherein said channel is at least 0.625 inch deep.

9. The ice skate assembly of claim 1 wherein said channel is at least 0.125 inch wide.

10. An ice skate and skate guard assembly comprising:

a skate boot with a sole;

a platform extending downwardly from said sole of said boot and terminating at a pair of longitudinally extending and laterally spaced shoulders with a bottom slot arranged between said shoulders;

a blade disposed partially in said slot and partially projecting out of said slot beyond said shoulders to an edge;

a skate guard having a longitudinally extending body formed with an open-topped channel bounded by a pair of laterally spaced side walls and a bottom wall, said channel sized to receive said edge of said blade and maintain said edge from contact with said bottom wall, wherein said side walls include respective upper support surfaces that engage said shoulders of said platform such that weight of a user is transferred from said skate to said skate guard directly between said shoulders and said upper support surfaces; and wherein said platform has a front nose portion that extends from a front tip of said blade rearwardly and upwardly, and wherein said skate guard includes an undercut cup portion at a front end of said platform that wraps around said front tip and pockets said nose in said cup portion precluding said skate guard from being pulled free of said ice skate without first sliding said skateguard forwardly to remove said nose from said undercut pocket of said skate guard.

11. An ice skate and skate guard assembly comprising:

a skate boot with a sole;

a platform extending downwardly from said sole of said boot and terminating at a pair of longitudinally extending and laterally spaced shoulders with a bottom slot arranged between said shoulders;

a blade disposed partially in said slot and partially projecting out of said slot beyond said shoulders to an edge;

a skate guard having a longitudinally extending body formed with an open-topped channel bounded by a pair of laterally spaced side walls and a bottom wall, said channel sized to receive said edge of said blade and maintain said edge from contact with said bottom wall, wherein said side walls include respective upper support surfaces that engage said shoulders of said platform such that weight of a user is transferred from said skate to said skate guard directly between said shoulders and said upper support surfaces; and at least a pair of wheels mounted on said skate guard in longitudinally spaced relation to one another, and wherein said bottom wall includes an irregular shaped floor with areas of peaks and areas of valleys adjacent said areas of peaks, and said skating edge of said blade is spaced from said peaks, and wherein said side walls include drain holes associated with at least some of said valleys.

* * * * *